United States Patent [19]

Miyazaki et al.

[11] 4,110,663

[45] Aug. 29, 1978

[54] PLASMA DISPLAY PANEL DRIVING CIRCUIT INCLUDING APPARATUS FOR PRODUCING HIGH FREQUENCY PULSES WITHOUT THE USE OF CLOCK PULSES

[75] Inventors: Togo Miyazaki; Masatoshi Shimizu, both of Tokyo, Japan

[73] Assignee: Nippon Electric Company, Ltd., Tokyo, Japan

[21] Appl. No.: 734,420

[22] Filed: Oct. 21, 1976

[30] Foreign Application Priority Data

Oct. 22, 1975 [JP] Japan ..... 50-127188

[51] Int. Cl.[2] ..... H05B 41/14

[52] U.S. Cl. ..... 315/169 TV; 340/324 M; 340/343

[58] Field of Search ..... 315/169 R, 169 TV; 340/166 EL, 324 M, 343

[56] References Cited

U.S. PATENT DOCUMENTS

| | | | |
|---|---|---|---|
| 3,883,775 | 5/1975 | Aling | 315/169 R X |
| 3,942,071 | 3/1976 | Krebs et al. | 315/169 TV |
| 3,953,762 | 4/1976 | Iwakawa et al. | 315/169 TV |
| 3,976,971 | 8/1976 | Iwakawa et al. | 340/324 M |
| 3,992,577 | 11/1976 | Amano et al. | 315/169 TV X |
| 4,028,584 | 6/1977 | Shutoh | 315/169 TV |

*Primary Examiner*—T.H. Tubbesing

[57] ABSTRACT

In a circuit for driving a plasma display panel, a blocking oscillator produces pulses varying between a positive and a negative voltage. Transistors controlled by first selection signals selectively supply first electrodes of the panel with either the complete bipolar pulses, or with only a predetermined one of the positive or negative pulse components. Further transistor switches controlled by second selection signals selectively connect and disconnect second display panel electrodes to ground. A constant voltage is applied to the disconnected second electrodes.

A gas discharge occurs at each intersection of the first electrodes supplied with the full bipolar pulse wave and the grounded second electrodes. In accordance with one aspect of the present invention, production of the driving pulses may be suspended either by a preselected one of the first and second selection signals or by coincidence logic operating upon preselected first or second selection signals.

16 Claims, 4 Drawing Figures

PLASMA DISPLAY PANEL DRIVING CIRCUIT INCLUDING APPARATUS FOR PRODUCING HIGH FREQUENCY PULSES WITHOUT THE USE OF CLOCK PULSES

BACKGROUND OF THE INVENTION

This invention relates to electronic display and, more specifically, to a circuit for driving an external electrode gas discharge display panel, commonly referred to as a plasma display panel.

A per se well known external electrode gas discharge display panel comprises first and second sets of electrodes. Each first electrode is disposed spatially opposite some or all the second electrodes with a gas discharge cell interposed therebetween, together with an insulating layer between the gas discharge cell and either one or both of the facing first and second electrodes. Circuits for driving an external electrode gas discharge display panel may be broadly classified into two types. A display driver circuit of a first type comprises a pair of drivers, one for selectively supplying first pulse sequences to the first electrodes, the other for selectively supplying second pulse sequences of an opposite phase to the second electrodes. The pulse voltage is from 130 to 160 volts. A gas discharge occurs in the cell disposed at each intersection of the first and second electrodes to which the pulses are supplied.

A display energizing circuit of a second general type comprises a driver and a switching circuit. The driver selectively supplies pulse sequences to selected of the first and second electrodes. The switching circuit selectively renders the others of the first and second electrodes on and off, e.g., grounded or ungrounded. The pulse voltage is from 260 to 320 volts. A gas discharge occurs in the cell situated at each intersection of the electrodes supplied with the pulses and the electrodes rendered on.

In a circuit of the first type, transistors capable of withstanding a high voltage must be used for each electrode. When the number of electrodes is large, the circuit is complex and expensive. Moreover, due to the high pulse voltage, it is very difficult to realize the circuit with an integrated circuit construction. As for the driver of a circuit of the second type, a transistor which can withstand a high voltage must again be employed for each electrode. The high voltage withstanding capability, however, is unnecessary for the transistors of the switching circuit. It is thus readily possible to fabricate the switching circuit in integrated circuit form. It has been mandatory, however, to use a d.c. source of a high voltage. Furthermore, the power consumption during switching has been considerable.

In U.S. Pat. No. 3,953,762 issued to Tsunekiyo Iwakawa and Akira Yano, assignors to the instant assignee, a circuit of the second type is disclosed wherein the circuitry is simplified. It is still necessary, however, to use a clock pulse generator and a second or auxiliary d.c. source. The power consumption is still considerable because a main power supply of a high d.c. voltage is required.

SUMMARY OF THE INVENTION

It is therefore an object of the present invention to provide a circuit for driving an external electrode gas discharge display panel which is operable with a d.c. supply of as low a voltage as about 20 volts or less.

It is another object of this invention to provide a plasma display driver circuit characterized by low power consumption.

It is still another object of this invention to provide a display driver circuit operable without a source of clock pulses and which does not employ an auxiliary d.c. source.

It is a further object of this invention to provide a display driver circuit which does not require transistors capable of withstanding a high applied voltage.

It is a still further object of this invention to provide a plasma display driver circuit which is readily manufactured in integrated circuit form, and which utilizes relatively simple circuitry.

Circuitry according to the present invention is supplied with d.c. power and first and second control voltages variable with respect to a reference potential, and drives an external electrode gas discharge display panel which includes first and second groups of electrodes. Each first electrode is disposed facing some or all of the second electrodes with a gas discharge cell interposed at each such intersection. An insulating layer is disposed between each gas discharge cell and either one or both of the facing first and second electrodes. The driver circuit comprises a point to be supplied with the reference potential, a transformer comprising a primary and a secondary winding, and pulse producing structure connected between the primary winding and the point of reference potential for producing a sequence of pulses in the secondary winding in response to the applied d.c. power. The pulses have positive and negative components reaching first and second predetermined voltages which are positive and negative with respect to the reference potential. The circuit further comprises first means connected to the point of reference potential and responsive to first control voltages for supplying the first electrodes with either the full bipolar pulse wave, or with only a prescribed polarity (positive or negative) component of the pulse wave, as signaled by the first control voltages. The circuit still further comprises second means connected to the point of reference potential and responsive to second control voltages for selectively supplying the second electrodes with a third predetermined voltage and the reference potential.

DESCRIPTION OF THE PREFERRED EMBODIMENTS

Figure 1:
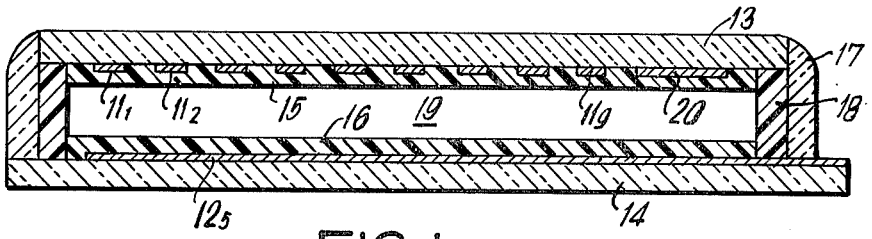
FIG. 1 is a schematic vertical cross section of an illustrative external electrode gas discharge display panel.
Figure 3:
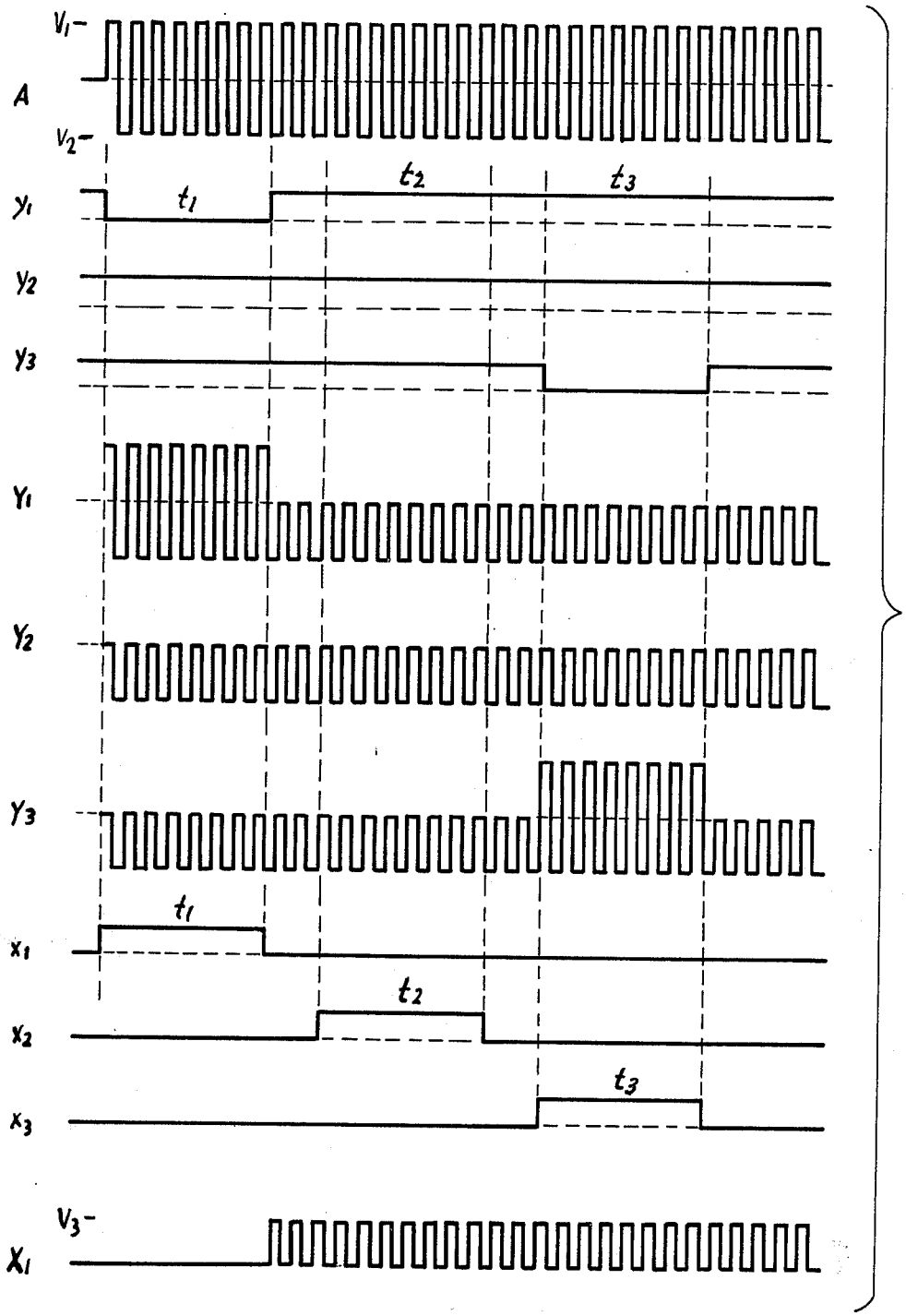
FIG. 3 illustrates wave forms appearing at selected points in the circuit of FIG. 2.

Referring now to FIG. 1 which is a substantial reproduction of FIG. 3 of a copending patent application Ser. No. 546,894 filed Apr. 2, 1975, by Kazunori Nishida, Tsunekiyo Iwakawa, and Hiroshi Hada, now U.S. Pat. No. 3,987,337 issued Oct. 19, 1976 assignors to the instant assignee, an external electrode gas discharge display panel comprises a plurality of first electrodes $11_1$, $11_2$, . . . , and $11_9$ and a plurality of second electrodes 12

(only one, $12_5$, being depicted). In the example being illustrated, the first and second electrodes 11 (suffixes being omitted) and 12 are arranged parallel on a first and a second dielectric plate 13 and 14 and covered by a first and a second continuous insulating layer 15 and 16, respectively. The dielectric plates 13 and 14 are hermetically sealed by a mass of sealing glass 17 with the insulating layers 15 and 16 inwardly directed, a spacer 18 being interposed between the plates 13 and 14 to form a space 19. The ends of the electrodes 11 and 12 (shown only for the electrodes 12) extend outwardly of the glass mass 17 to provide electrical connections to a driving circuit for the display panel. The space 19 is evacuated through an exhaust pipe (not shown) attached to one of the plates 13 and 14 in communication with the space 19 and thereafter filled with an ionizable gas or gas mixture through the exhaust pipe, which is subsequently sealed. The electrodes 11 and 12 thus define a plurality of gas discharge cells. Either the first or the second electrodes 11 or 12 may be in a form of segmented electrodes as exemplified in U.S. Pat. No. 3,849,686 granted to Togo Miyazaki, one of the present applicants and assignor to the instant assignee. One of the insulating layers 15 and 16 may be omitted. Alternatively, the insulating layer 15 or 16 or layers 15 and 16 may individually cover the electrodes 11 or 12 or 11 and 12. The display panel may further comprise additional electrode or electrodes as indicated at 20. As the case may be, it is convenient to consider that additional electrode 20 according to Miyazaki as one of the first electrodes which is supplied with a pulse sequence simultaneously with application to at least one selected first electrode of another pulse sequence. The display panel may also comprise an intermediate dielectric plate having holes formed therethrough to further segregate the discharge cells as illustrated in the Miyazaki patent references hereinabove.

Figure 2:
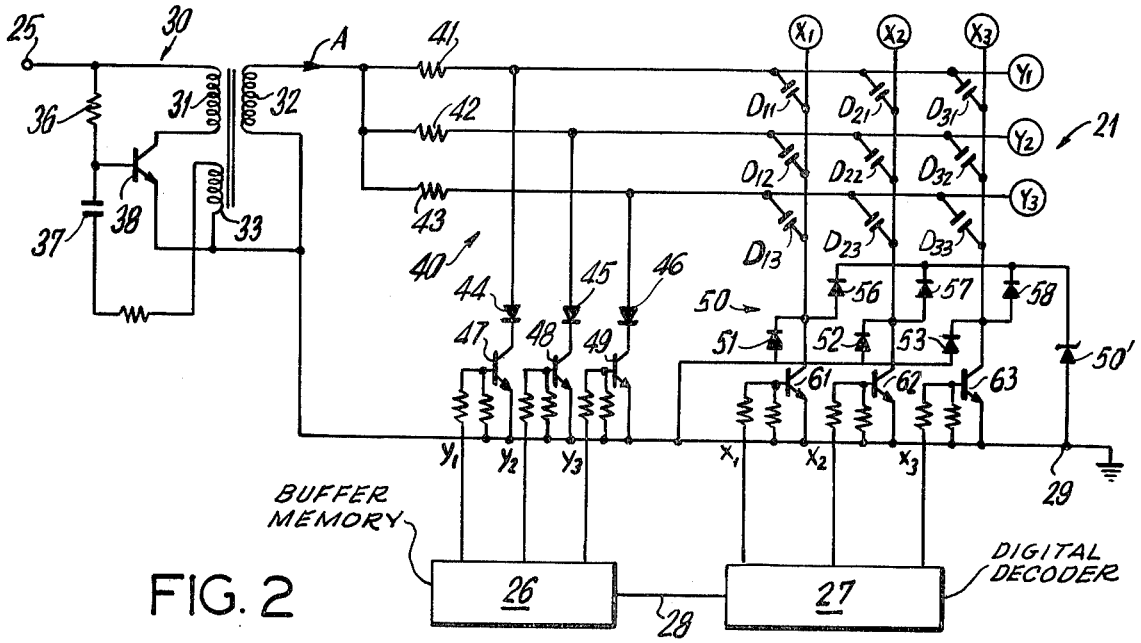
FIG. 2 schematically depicts a gas discharge display driver circuit according to a first embodiment of the instant invention.

Turning to FIGS. 2 and 3, a circuit according to a first embodiment of the present invention is for driving in a time shared fashion an external electrode gas discharge display panel 21, employing a d.c. source 25, first control voltages (selection signals) supplied from a buffer memory 26, and second control voltages (selection signals) supplied from a digital (e.g., cyclically repeating) decoder 27. The memory 26 and the decoder 27 are interconnected as shown at 28 and described in the Iwakawa et al. patent cited hereinabove. The disclosures of each patent and patent application referred to herein is hereby incorporated herein by reference. In FIG. 2, only three first electrodes $Y_1$, $Y_2$, and $Y_3$, only three second electrodes $X_1$, $X_2$, and $X_3$, and only nine gas discharge cells $D_{11}$, $D_{12}$, $D_{13}$, $D_{21}$, $D_{22}$, $D_{23}$, $D_{31}$, $D_{32}$, and $D_{33}$ are depicted for mere simplicity of illustration. Any number may of course be employed.

The FIG. 2 circuit includes a point 29 of a reference potential, such as ground, and a pulse generator 30 which generates a sequence of pulses "A" which are preferably of a relatively high frequency, such as several kilohertz. The pulses "A" have positive and negative components reaching first and second predetermined voltages $V_1$ and $-V_2$ which are positive and negative with respect to the reference potential. The pulse generator 30 is in effect a free running blocking oscillator and comprises a transformer having a primary, a secondary, and a tertiary winding 31, 32, and 33. One end of the secondary and third windings 32 and 33 is connected to the point 29 of reference potential. The pulse generator 30 further comprises pulse producing circuit elements including a resistor 36, a capacitor 37, and a transistor 38. In the example of the first embodiment being illustrated, the transistor 38 is an NPN transistor having a base, an emitter, and a collector electrode. The base electrode is supplied with d.c. power through the resistor 36 and connected through the capacitor 37 to the ungrounded end of the third winding 33. The collector electrode is connected to one end of the primary winding 31, the other end thereof being supplied with the d.c. power. The emitter of the transistor 38 is connected to the transformer tertiary winding 33.

In operation of the pulse generator 30, the transistor 38 is turned on (conducts) at least when a d.c. voltage of about 15 to 20 volts is supplied to the base electrode through the resistor 36. A positive-going pulse then appears at the ungrounded end of the secondary winding 32. The pulse reaches the first predetermined voltage $V_1$ determined by the turns ratio of the transformer, the polarity relation between the primary and secondary windings 31 and 32, and the characteristics of the transformer ferromagnetic core material. While this occurs, a negative-going pulse is supplied to the transistor base electrode through the tertiary winding 33 and the capacitor 37 to eventually turn off the transistor 38. Also, the flyback voltage produced in the primary winding 31 makes that negative-going pulse appear at the ungrounded end of the secondary winding 32 which varies from the first predetermined voltage $V_1$ to the second voltage $-V_2$. The latter pulse applies a positive-going pulse to the base electrode to render the transistor 38 on again. The astable pulse generator 30 repeats this mode of operation to generate the continuous pulse sequence "A".

Further referring to FIGS. 2 and 3, the composite display driving circuit comprises a driver 40 connected to the point 29 of reference potential and supplied with the first control voltages from the buffer memory 26 to supply the first electrodes $Y_1$ to $Y_3$ either with the pulse sequence "A", or with only a predetermined one (positive or negative) component thereof in compliance with the control voltages. In the example being illustrated, the predetermined components are the negative ones. It is noted that the second electrodes $X_1$ to $X_3$ are cyclically selected during a first, a second, and a third time interval $t_1$, $t_2$, and $t_3$, respectively, in the manner described below. Control voltages for the first electrodes $Y_1$ to $Y_3$ are designated by $y_1$, $y_2$, and $y_3$, respectively, and reside at low and high states when a display contribution being given by the display panel 21 is to be illuminated and not illuminated. It is presumed here for mere convenience that a desired display is provided by making gas discharges occur in two of the gas discharge cells, for example the cells $D_{11}$ and $D_{33}$. During the desired display, a first of the control voltages $y_1$ is repeatedly rendered low during the first interval $t_1$ and high during the second and third intervals $t_2$ and $t_3$. A second of the control voltages $Y_2$ is kept high. A third $y_3$ is repeatedly rendered low only during the third interval $t_3$.

The driver 40 comprises a plurality of resistors 41, 42 and 43 each connecting the ungrounded end of the secondary winding 32 to the first electrodes $Y_1$-$Y_3$. The driver 40 further comprises a serial diode 44, 45, or 46 and transistor switch 47, 48 or 49 each connecting one of the resistors 41-43 and the point 29 of reference potential (e.g., ground). The diode-transistor switch series connections are thus each associated with a particular first electrodes $Y_1$, $Y_2$ or $Y_3$. Base electrodes of the transistors 47 to 49 are supplied with the respective control voltages $y_1$ to $y_3$.

During the periodically repeating first intervals, $t_1$, only the transistor 47 assigned to the electrode $Y_1$ is off (nonconductive) to supply the pulse sequence "A" to the electrode $Y_1$ through the resistor 41. During the third intervals $t_3$, only the transistor 49 assigned to the electrode $Y_3$ is off to supply the pulse sequence "A" to electrode $Y_3$ through the resistor 43. At other times, the transistors 47 to 49 conduct to clamp the electrodes $Y_1$-$Y_3$ to substantially the reference potential during positive excursions of the wave "A", and to supply only the negative components to the first electrodes $Y_1$ to $Y_3$ as depicted in the FIG. 3 waveforms for electrodes $Y_1$ to $Y_3$.

Still further referring to FIGS. 2 and 3, the driving circuit comprises a switching circuit 50 connected to the point 29 of reference potential and supplied with the second control voltages from the decoder 27 to selectively supply the second electrodes $X_1$-$X_3$ essentially with a third predetermined voltage $V_3$ and the reference potential. In the example being illustrated, the third predetermined voltage $V_3$ is positive with respect to the reference potential. Second control voltages, for the second electrodes $X_1$ to $X_3$, are designated by $x_1$, $x_2$ and $x_3$, respectively, and cyclically switch to a high level from a low state during the first through third intervals $t_1$ to $t_3$, respectively.

The switching circuit 50 includes a constant voltage device 50', such as a Zener diode or a series connection of two or more Zener diodes, having a first termination connected to the point 29 of reference potential and a second termination. First diodes 51, 52, and 53 are connected between the point 29 of reference potential and the respective second electrodes $X_1$ to $X_3$; second diodes 56, 57, and 58 connected between the respective second electrodes $X_1$ to $X_3$ and the second termination of constant voltage device 50'; and switching transistors 61, 62, and 63 connected between the point 29 of reference potential and the respective second electrodes $X_1$ to $X_3$. Base electrodes of the switching transistors 61 to 63 are supplied with the second control voltages $x_1$ to $x_3$ to cyclically select (enable) the second electrodes $X_1$ to $X_3$ by clamping these electrodes substantially to the reference potential. It is to be understood here that either the pulses "A" or the predetermined ones of the positive and negative components (here, negative) supplied to the first electrodes $Y_1$ to $Y_3$ induce pulses of the same phase at the second electrodes $X_1$ to $X_3$ through the gas discharge cells $D_{11}$ to $D_{33}$ and the interposed insulating layer 15 or 16 or layers 15 and 16. When the switching circuit 50 is isolated from the display panel 21, the heights of the induced pulses depend on the number of selected one or ones of the first electrodes $Y_1$ to $Y_3$. With the switching circuit 50 connected to the display panel 21, the induced pulses swing the potentials of the second electrodes $X_1$ to $X_3$ substantially between the reference potential and the third predetermined voltage $V_3$ if the associated switching transistors 61 to 63 are not conducting. In other words, the potential of each second electrode $X_1$, $X_2$, or $X_3$ vary as illustrated in FIG. 3 (at "$X_1$" for the second electrode $X_1$). As a result, the actual pulse height applied across each selected cell $D_{11}$ or $D_{33}$ during the period each is illuminated is substantially equal to the first predetermined voltage $V_1$ plus the absolute value $V_2$ of the second predetermined voltage. On the other hand, the actual pulse height applied across each unselected cell is substantially given by the first-mentioned pulse height less the third predetermined voltage $V_3$ because the induced pulses are of the same phase as the pulses applied to the first electrodes $Y_1$ to $Y_3$ as described.

In connection with the driving circuit thus far illustrated with reference to FIGS. 2 and 3, it must be understood that the first through third predetermined voltages $V_1$, - $V_2$, and $V_3$ should satisfy the following inequalities:

$$V_1 + V_2 > V_{umax},$$

peak value $V_2$ or $V_1$ of the predetermined negative or positive components $< V_{umin}$,
and $$V_1 + V_2 - |V_3| < V_{umin},$$

where $V_{umax}$ and $V_{umin}$ respectively represent the maximum and minimum unidirectional firing voltages of gas discharge cells of the display panels 21 to be driven by the driving circuit according to this invention. In general, the maximum value Vumax ranges from 220 to 260 volts while the minimum value Vumin varies from 180 to 200 volts. It is therefore desirable to design the driving circuit to make the sum of the first predetermined voltage $V_1$ and the absolute value $V_2$ of the second predetermined voltage higher than about 260 volts and the above-mentioned peak value $V_2$ or $V_1$ lower than about 180 volts to provide operating margins over display panel life and aging. Under these circumstances, the diodes 44 to 46 of the driver 40 must withstand 180 volts or more. The other peak value $V_1$ or $V_2$ of the positive or negative components to be cancelled by the driver 40 should be as low as possible to reduce power consumption. It is undesirable, however, to unduly reduce the peak value $V_1$ or $V_2$ in order to insure a sufficient operable range for the display panel 21. As a consequence, the latter peak value $V_1$ or $V_2$ is preferably about 130 volts. The first-mentioned peak value $V_2$ or $V_1$ of the predetermined negative or positive components is therefore about 170 volts.

As for the third predetermined voltage $V_3$, a large absolute value is preferred from the sole viewpoint of operable range for the display panel 21. A high absolute value, however, requires a high voltage withstanding capability for the switching transistors 61 to 63. As a result, the absolute value is preferably about 100 volts when the switching circuit 50 is to be realized by a hybrid integrated circuit. When the switching circuit 50 is realized by an MOS integrated circuit, the absolute value should be lower than the voltage which the integrated circuit withstands.

A typical example of the pulse generator 30 for generating the pulse sequence "A" comprises a primary winding 31 of 18 turns, a secondary winding 32 of 150 turns, a third winding 33 of 4 turns, a transformer core having an induction coefficient AL of 350, a resistor 36 of $3.3 \times 10^3$ ohms, a capacitor 37 of $1 \times 10^4$ pF, and a transistor 38 of the type 2SD288 manufactured and sold by Nippon Electric Co., Ltd., Tokyo, Japan. The unnumbered resistor connected between the third winding 33 and capacitor 37 is 100 ohms. The frequency of the pulses A produced by the typical pulse generator 30 is 150 kHz, which is preferred to several kilohertz mentioned hereinabove in conjunction with production of the pulses "A".

Figure 4:
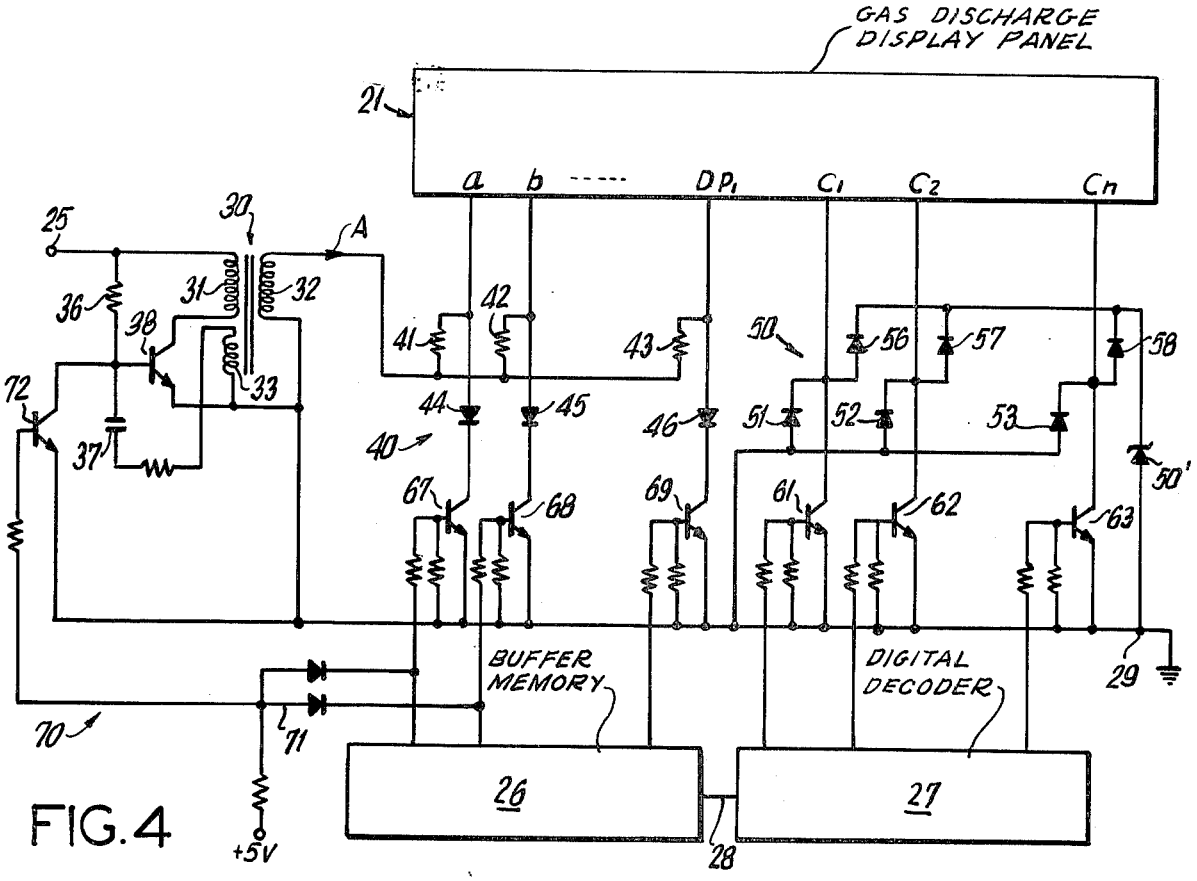
FIG. 4 comprises a schematic diagram of a display driver circuit according to a second embodiment of the present invention.

Referring now to FIG. 4, a circuit according to a second embodiment of this invention is adapted for connection to an external electrode gas discharge display panel 21, a d.c. source 25, a buffer memory 26, and a digital decoder 27 as was the case for the driver circuit according to the first embodiment. The driving circuit of FIG. 4 comprises elements similar to those designated by like reference numerals as in FIG. 2. In addition, the pulse producing circuit of FIG. 4 comprises a detection or blanking circuit 70 connected to at least one of the driver 40 (as shown) and the switching circuit 50 (in comparable logic gate fashion for the state-sensing gate diodes) for suspending production of the pulse sequence "A" when that one of the driver 40 and switching circuit 50 supplies none of the pulses "A" and the predetermined positive or negative components to the first electrodes and none of the third predetermined voltage $V_3$ and the reference potential to the second electrodes, to which the detection circuit 70 is connected.

Further referring to FIG. 4, it is preferred for a circuit according to the second embodiment that the display panel 21 comprises at least one predetermined first or second electrode that is always selected when the display panel 21 is put in its displaying operation and kept in the selected state either continuously or intermittently so long as the display panel 21 gives a desired display. When included in the first electrodes, the additional electrode 20 illustrated with reference to FIG. 1 satisfies the condition. Although the electrodes selected in a time shared fashion are always selected in a cyclic manner as long as the display panel 21 is maintained in the displaying operation, any predetermined one thereof is not held in the sense mentioned above even in the intermittently selected state because others thereof are also selected in the interim. In this connection, it should be understood that the driver 40 and switching circuit 50 of a circuit according to this invention comprise a plurality of on-off means and a plurality of switching means at least one each of which selects the at least one predetermined electrode and at least one opposing electrode to supply the selected electrodes with the pulses "A" and the reference potential, respectively. The detection circuit 70 is connected in the driver 40 or switching circuit 50 to the at least one of the on-off or switching means.

Still further referring to FIG. 4, it is assumed merely for clarity of description that the display panel 21 comprises segmented electrodes *a, b,* . . . and D.P. (decimal point) for numerals 0 to 9 as the first electrodes. The segmented electrodes are very often arranged in a plurality of groups, such as *n* groups, each for displaying a desired one of the numerals 0 to 9, as described in the Miyazaki patent referenced hereinabove. The display panel 21 further comprises second electrodes $C_1$, $C_2$, . . . , and $C_n$, one for each group of the segmented electrodes. Each group of the segmented electrodes except that for the decimal point are usually seven or eight in number and are arranged in a substantial figure-of-eight configuration to define one display decimal digit. Among these seven or eight electrodes, at least one of two predetermined electrodes *a* and *b* is always selected and kept in the selected state in the sense mentioned hereinabove.

Referring more particularly to FIG. 4, the detection circuit 70 comprises an AND gate 71 having two inputs connected to the transistors 67 and 68 assigned to the two predetermined electrodes *a* and *b*. The AND gate 71 has one output. The detection circuit 70 further comprises a control transistor 72 which has a base electrode connected to the AND gate output, an emitter electrode connected to the point 29 of reference potential, and a collector electrode connected to the base electrode of the transistor 38. The control transistor 72 is rendered off when at least one of the first control voltages for the electrodes *a* and *b* is low. This allows the pulse generator 30 to produce the pulse sequence "A". When both of the first control voltages for the electrodes *a* and *b* are high, the control transistor 72 is turned on to make the pulse generator 30 suspend production of the pulse sequence A.

Let it now be further presumed that the display panel 21 is for ten digits and that only four digits are to be displayed. The buffer memory 26 renders the first control voltages low for at least one of the two predetermined electrodes *a* and *b* only during the time that the second electrodes for the four digits are selected and keeps the first control voltages high during the remaining time of the cyclic selection of the second electrodes. The power consumed under the circumstances is only 30 to 40% of the power consumed when the driving circuit includes no detection circuit 70.

It will be appreciated that a driving circuit according to this invention does not require a power source of high d.c. potential, a separate clock pulse generator, and an auxiliary d.c. voltage source. The on-off and switching transistors 46 to 49 and 61 to 63 may have relatively low voltage withstanding capabilities. Furthermore, it is possible to optionally vary the frequency of the pulses "A" by adjusting the time constant of the resistor 36 and capacitor 37. As will readily be understood by those skilled in the art, it is not always necessary to operate the driving circuit in a time shared fashion. Since the first and second electrodes are equivalent to each other, it is possible to supply the pulses "A" to the X or C electrodes shown in FIG. 2 or 4, and to switch the Y or segmented electrodes. The driving circuit may comprise additional on-off and/or switching transistors and the related elements besides those equal in number to the corresponding electrodes of an external electrode gas discharge display panel 21 to be driven thereby. Use may suitably be made of PNP and NPN transistors with the diodes 44, 50′, 51, and the like accordingly directed and with the polarities of the control voltages correspondingly selected.

In specific conjunction with the second embodiment of this invention, use of the AND gate 71 is unnecessary when the display panel 21 to be driven comprises the additional electrode 20 illustrated with reference to FIG. 1. On the other hand, it is quite often the case that a relatively few plurality of the first or second electrodes, such as the two predetermined segmented electrodes, *a* and *b* exemplified hereinabove, are selected whenever the display panel 21 is put into the displaying operation and are kept in the selected state in the sense used herein. Use may be made in this event of an AND gate 71 having relatively few inputs, without injecting much complication into the circuitry.

The above described arrangements are merely illustrative of the principles of the present invention. Numerous modifications and adaptions thereof will be readily apparent to the skilled in the art without departing from the spirit and scope of the present invention.

What is claimed is:

1. A circuit responsive to d.c. power and first and second control voltages variable with respect to a reference potential for driving an external electrode gas discharge display panel comprising first and second electrode pluralities, each first electrode spatially opposing said second electrodes with a gas discharge cell interposed therebetween together with an insulating layer between said gas discharge cell and at least one of said opposed first and second electrodes, said circuit comprising a point to be supplied with said reference potential, a transformer comprising a primary and a secondary winding, pulse producing means connected between said primary winding and said point for producing a sequence of pulses having positive and negative components reaching a first and a second predetermined voltage which are positive and negative with respect to said reference potential, first means connected to said point and responsive to said first control voltages for supplying said first electrodes substantially with said pulses or with a preselected ones of said positive or negative components of said pulses dependent upon said first control voltages, and second means connected to said point and responsive to said second control voltages for selectively supplying said second electrodes with a third predetermined voltage and said reference potential.

2. A circuit as claimed in claim 1, wherein said first means comprises a plurality of resistors each having a first and a second end, said first resistor ends being connected to said secondary winding, means for connecting the second resistor ends to said first electrodes, respectively, and on-off means between said point and said second resistor ends for disconnecting and connecting in response to said first control voltages said second resistor ends from and to said point.

3. A circuit as claimed in claim 2, wherein said on-off means comprises a series connection of a diode and a switching transistor connected between said point and each of said second ends, said switching transistors being selectively rendered on and off in response to said first control voltages.

4. A circuit as claimed in claim 2, wherein said second means comprises a constant voltage device comprising a first termination connected to said point and a second termination, a plurality of controllable connections, each having a first and a second state and comprising a first terminal connected to said point, a second terminal connected to said second termination, and a third terminal, means for connecting the third terminals to said second electrodes, respectively, and switching means operatively coupled to said controllable connections and responsive to said second control voltages for selectively putting said controllable connection in the first and second states, each controllable connection, when put in its first and second states, connecting and disconnecting its third terminal to and from its first terminal, respectively, said constant voltage device developing said third predetermined voltage between said first and second terminations when supplied with a potential through said discharge display panel and that portion of at least one controllable connection put in its second state which lies between its first and second terminals.

5. A circuit as claimed in claim 4, wherein each of said controllable connections further comprises a first diode connected between its first and third terminals, a second diode connected between its second and third terminals, and a switching transistor connected between its first and third terminals, said switching means being rendered on and off in response to said second control voltages.

6. A circuit as claimed in claim 1, wherein said transformer further comprises a tertiary winding having one end connected to said point and said pulse producing means comprises a single resistor, a capacitor, and a transistor having a base electrode, an emitter electrode, and a collector electrode, said base electrode being adapted to receive said d.c. power through said single resistor and those pulses through said capacitor which are induced across said tertiary winding and are oppositely poled with respect to the pulses of said sequence, one of said emitter and collector electrodes being connected to said point, the other of said emitter and collector electrodes being connected to one end of said primary winding, the other end of said primary winding being adapted to receive said d.c. power.

7. A circuit as claimed in claim 1, wherein said pulse producing means comprises detection means connected to at least one of said first and second means for suspending production of said pulses when that one of said first and second means supplies none of said pulses and said predetermined components to said first electrodes and none of said third predetermined voltage and said reference potential to said second electrodes, respectively, to which said detection means is connected.

8. A circuit as claimed in claim 7, wherein said transformer further comprises a tertiary winding having one end connected to said point and said pulse producing means comprises a single resistor, a capacitor, and a transistor having a base electrode, an emitter electrode, and a collector electrode, said base electrode being adapted to receive said d.c. power through said single resistor and those pulses through said capacitor which are induced across said tertiary winding and go oppositely with respect to the pulses of said sequence, one of said emitter and collector electrodes being connected to said point, the other of said emitter and collector electrodes being connected to one end of said primary winding, the other end of said primary winding being adapted to receive said d.c. power, said detection means being connected between said base electrode and said at least one of first and second means.

9. A circuit as claimed in claim 8, said display penel having at least one predetermined electrode among said first and second electrodes that is always selected to make said display panel give at least one display whenever said display penel is driven into its displaying operation and that is kept in the selected state so long as said display panel is driven to give a display, wherein said first and second means comprise switching means for selecting said predetermined electrode and at least one opposing electrode among said first and second electrodes by supplying said sequence of pulses and said reference potential thereto, respectively, said detection means operatively connecting said base electrode and one of said switching means that selects said predetermined electrode.

10. A circuit as claimed in claim 9, said at least one predetermined electrode being a plurality in number, wherein said detection means comprises an AND gate having inputs, said plurality in number, and an output, said inputs being connected to said one of on-off and switching means, said detection means further comprising pulse production control means between said output, said base electrode, and said point for disconnecting said base electrode from said point whenever said display panel is put into said displaying operation and otherwise connecting said base electrode to said point.

11. In combination in a plural cell display panel driving circuit for driving a display panel having first and second electrode pluralities, pulse source means for supplying a pulse wave characterized by positive and negative peak excursions, $V_1$ and $-V_2$ with respect to a reference potential, means connecting said pulse source means to the first display electrodes, plural first switch means each connected to an associated first electrode for selectively suppressing or permitting a predetermined excursion polarity of said pulse wave relative to said reference potential at said associated first electrode, plural second switch means each selective connecting a different one of said second electrodes to said reference potential, and regulatory means for applying a voltage not exceeding a third potential $V_3$ and said reference potential to said second electrodes not then connected to reference potential by an associated, conductive second switch means, such that:

$$V_1 + V_2 > V_{umax}, \text{ and}$$
$$V_1 + V_2 - |V_3| < V_{umin},$$

where $V_{umax}$ and $V_{umin}$ respectively represent maximum and minimum unidirectional firing voltages of display panel cells.

12. A combination as in claim 11 wherein said regulating means comprises first clamping means for clamping each second electrode to the potential $V_3$, and second clamping means, oppositely poled with respect to said first clamping means, for clamping each second electrode to said reference potential.

13. A combination as in claim 11 further comprising means for disabling said pulse source means when no display component is to be generated.

14. A combination as in claim 13 wherein said disabling means includes coincidence logic having an output connected to said pulse source and plural inputs connected to sense the state of at least one of said first and second switch means.

15. A combination as in claim 11 wherein said pulse source means comprises a blocking oscillator.

16. A combination as in claim 11 further comprising means for controlling said plural first and second switch means.

* * * * *